United States Patent [19]

Baltzer et al.

[11] Patent Number: 4,919,263

[45] Date of Patent: Apr. 24, 1990

[54] CONTAINER PACKAGING

[75] Inventors: Donald L. Baltzer; Jack D. Kindelberger, both of Navarre; William Bartko, Canton, all of Ohio

[73] Assignee: Vail Industries, Inc., Navarre, Ohio

[21] Appl. No.: 258,800

[22] Filed: Oct. 17, 1988

[51] Int. Cl.[5] ..... B65D 85/00

[52] U.S. Cl. ..... 206/326; 206/586; 229/23 R

[58] Field of Search ..... 206/326, 586, 592, 594; 220/400; 229/23 R

[56] References Cited

U.S. PATENT DOCUMENTS

| | | | |
|---|---|---|---|
| 1,852,113 | 4/1932 | Gomes . | |
| 2,192,666 | 3/1940 | Roos . | |
| 2,348,483 | 5/1944 | Lacy, II et al. . | |
| 2,571,748 | 10/1951 | Newman . | |
| 2,633,982 | 4/1953 | Addison . | |
| 2,808,978 | 10/1957 | Wright et al. | 206/586 |
| 3,073,438 | 1/1963 | Martin . | |
| 3,986,611 | 10/1976 | Dreher . | |
| 4,109,876 | 8/1978 | Kratochvil, Jr. . | |
| 4,170,297 | 10/1979 | Johnson . | |
| 4,311,239 | 1/1982 | Schlicker . | |
| 4,717,025 | 1/1988 | Maurer | 206/586 |

*Primary Examiner*—Carroll B. Dority

*Attorney, Agent, or Firm*—Fay, Sharpe, Beall, Fagan, Minnich & McKee

[57] ABSTRACT

A packaging assembly is adapted to protect an associated piece of furniture during shipment. The assembly includes a base member, corner posts, and a cover member received over upper ends of the corner posts. The base member includes block members disposed in the corners adapted to cooperate with the corner posts or, alternatively, adapted to receive mating block members in extension members. The extension members provide for incremental increases in the dimensions of the packaging assembly to aid in readily converting a standard packaging assembly to different sizes of furniture pieces.

16 Claims, 4 Drawing Sheets

CONTAINER PACKAGING

BACKGROUND OF THE INVENTION

This invention pertains to the art of packaging, and more particularly to packaging large articles of furniture.

The invention is particularly applicable to a container packaging arrangement for a desk and will be described with particular reference thereto. However, it will be appreciated that the application has broader applications and may be advantageously employed in packing other articles of furniture, as well as other cargo.

In the past, and as still widely used today, container packaging has been comprised of a large number of packaging elements that cooperate to support and protect an article from damage during shipment or handling. A substantial number of articles are returned or sold as damaged goods due to the insufficient packing arrangement.

Typically, container packaging for large articles of furniture is built around or based on a pallet, skid, or similar sturdy base member. The furniture article must be supported by and protected from damage with the base member since it serves a solely utilitarian function in adapting the container packaging for handling by equipment such as forklifts.

In prior arrangements, each exposed surface of the furniture or article is protected by a separate packing element, or typically several packing elements in an effort to limit potential damage thereto. As can be expected, this results in a large number of individual packing elements that must be produced and assembled to cooperate with each other. Beyond the mere inventory problem of maintaining sufficient packing elements on hand, the packing process is particularly labor intensive. Additionally, manufacture of the various packing elements becomes relatively complex due to the myriad of shapes and sizes of the packing elements. Assembling all the various elements to adequately pack and protect an article of furniture requires special training in addition to maintaining a large number of elements in inventory as noted above.

Still another difficulty encountered in prior container packaging assemblies is the inability to accommodate incremental increases in the size of furniture articles. By way of example, desks increase in six inch increments and thus a series of small, medium, and large desks requires different sized packaging elements. No systematic method or structural arrangement has been provided to deal with the size variations in furniture.

SUMMARY OF THE INVENTION

The present invention contemplates new and improved container packaging that overcomes all of the above-referred to problems and provides a simple, economical assembly.

According to a more limited aspect of the invention, a packaging assembly includes a base member having an elongated, generally planar deck and a deck support member defined by a folded sheet of material. First, second, third, and fourth corner posts each have one end disposed at respective corners of the base member and receive a cover member on their opposite ends.

According to still another aspect of the invention, block members are adapted to cushion legs of an associated piece of furniture received in the base member.

The block members are spaced inwardly from longitudinal edges of the base member.

According to yet another aspect of the invention, an extension member is matingly received on one end or both ends of the base member to accommodate a different size article of furniture.

A principal advantage of the invention is the reduction of component parts in the packaging assembly.

Yet another advantage of the invention resides in the reduced time necessary to pack an article of furniture.

A still further advantage of the invention is realized in the ability to accommodate incremental increases in sizes of furniture.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
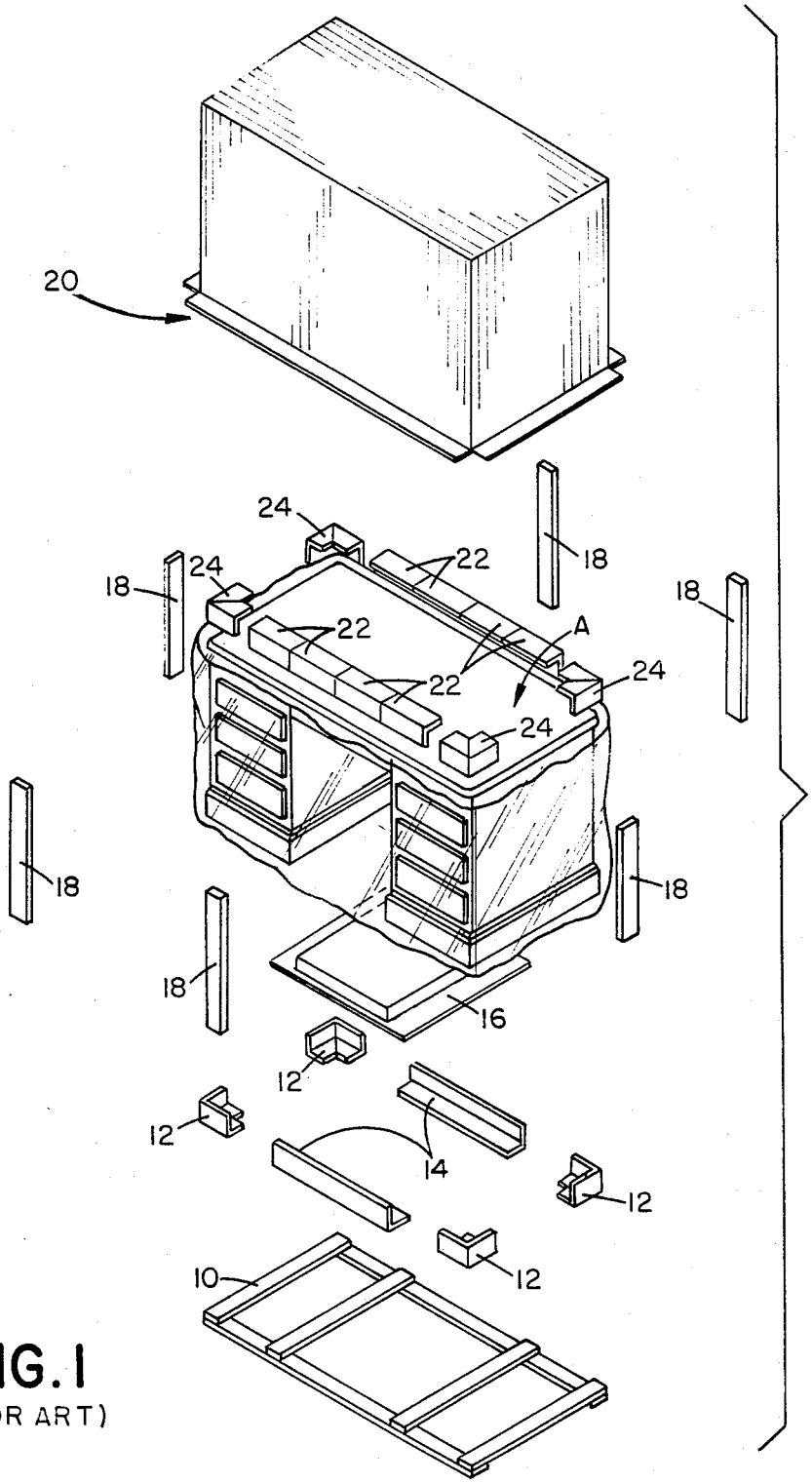
FIG. 1 (PRIOR ART)
FIG. 1 is an exploded, perspective view of the prior art packaging assembly.

Referring now to the drawings wherein the showings are for purposes of illustrating the preferred embodiment of the invention only and not for purposes of limiting same, the FIGURES show an article of furniture, such as a desk A, received in a container packaging assembly B. The packaging assembly includes a base member C, corner posts D, top or cover member E, and protective wrap F. When packaging articles that incrementally increase in size, the packaging assembly may also include extension members G to accommodate the size increase.

The structural arrangement of FIG. 1 will be briefly described to illustrate some of the problems associated with the prior art. A wood pallet or skid 10 is generally disposed at the base of the desk A to provide a sturdy bottom support member. Interposed between the skid and the desk are four corner elements 12 and front and rear lower edge packing elements 14. These packaging elements 12, 14 are typically formed of a paper material such as corrugated paper that is folded along predetermined score lines so that one portion of each element is received beneath the desk and provides a protective cushion. This arrangement prevents an exposed surface of the desk from contacting the skid.

An enlarged packaging element 16 is disposed between upright legs of the desk. The packaging element 16 has generally planar edge regions received beneath the desk legs and a stepped central portion extending between the legs. A series of six side elements 18 are spaced along vertically extending peripheral surfaces of the desk. Preferably, two of these packaging elements are received along each longitudinal edge and one element disposed approximately midway along each side edge of the desk. The side elements are adapted to extend substantially the full height of the desk. Additionally, the side elements space the desk from the sidewalls of an enclosing box 20. The top of the desk is protected by approximately eight upper edge packing elements 22 and four corner elements 24. These packaging elements are also preferably formed of a corrugated material to protect the top surface of the desk. Overall the entire prior art packaging assembly includes anywhere from twenty-five to thirty packaging elements that take undue time in securely packing the desk for shipment.

According to the preferred embodiment of the subject invention shown in FIGS. 2–6, the new packaging assembly substantially reduces the number of packaging elements required to securely pack and protect a piece of furniture. Again, for ease of reference, a desk is illustrated as the article of furniture although it will be understood that other furniture or articles could be packaged in a similar manner and without departing from the scope and intent of the subject invention.

Figure 2:
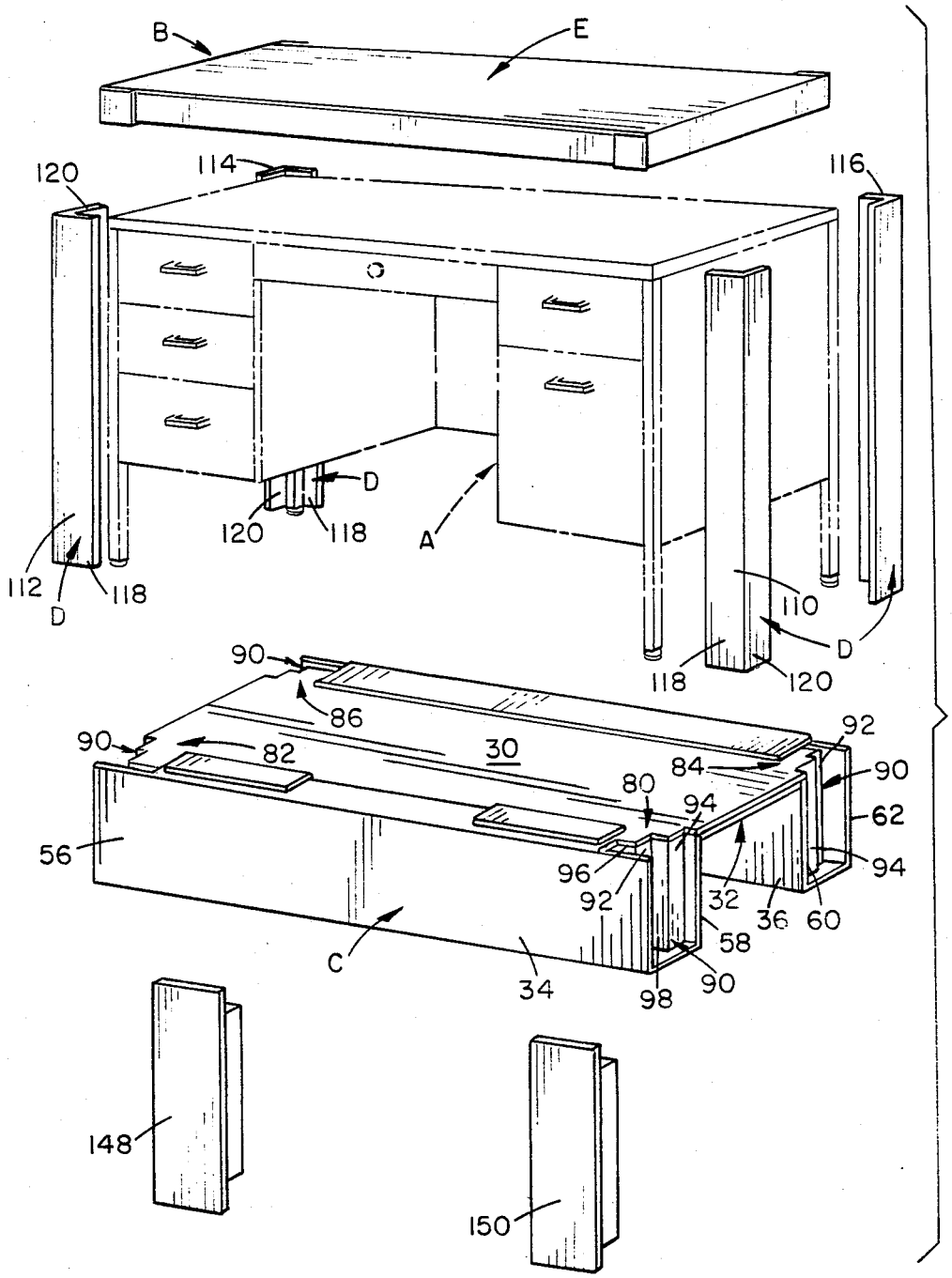
FIG. 2 is an exploded, perspective view of the subject new packaging assembly with an associated desk shown in phantom.
Figure 5:
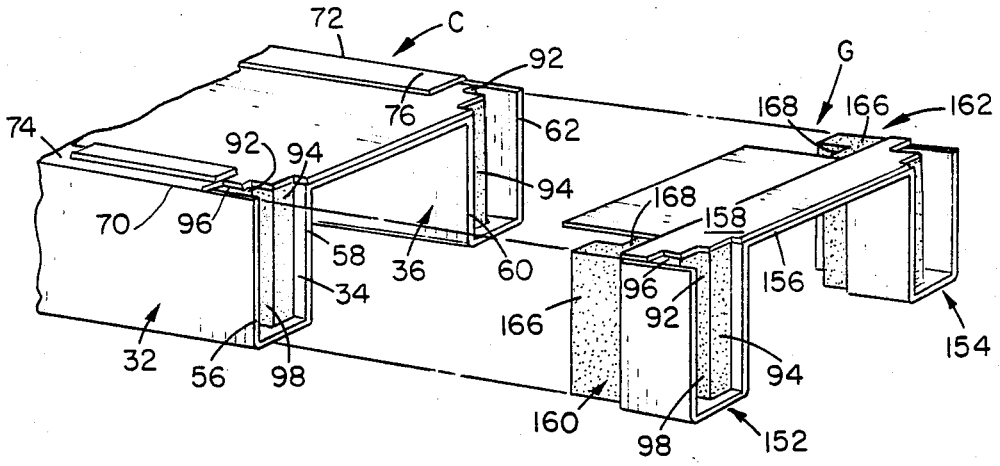
FIG. 5 is an enlarged, perspective view of one end of an assembled base member adapted to receive an extension member; and, FIG. 6 illustrates the final assembled package enclosed in a protective wrap.

With particular reference to FIGS. 2 and 5, the base member C includes a generally planar deck 30 formed from corrugated paper or the like that is received on a deck support member 32. In the preferred embodiment, the deck support member is an integral, unitary piece of corrugated material folded along preselected score lines to define longitudinally extending leg portions 34, 36 that receive opposed, longitudinal edges of the deck and space the deck from the ground surface.

Figure 3:
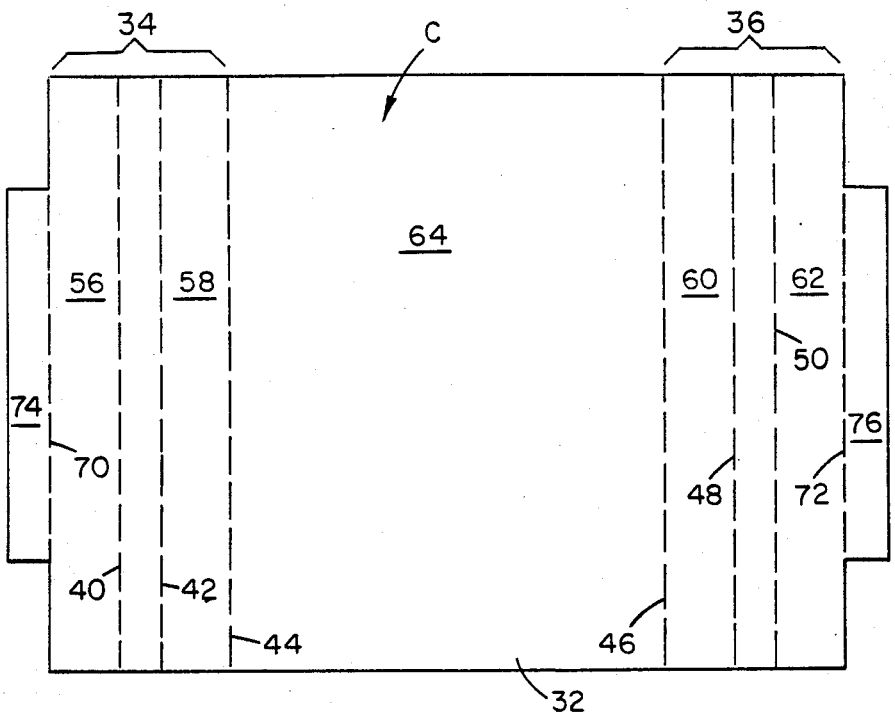
FIG. 3 is a plan view of the base member prior to folding.
Figure 4:
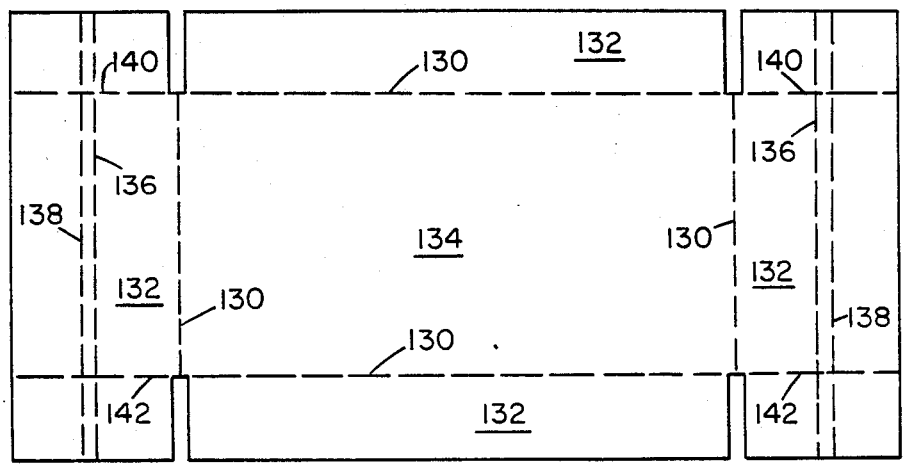
FIG. 4 is a plan view of the top member prior to folding.

With additional reference to FIG. 3, the original, planar configuration of the support member is illustrated and includes a series of predetermined score lines. The score lines 40, 42, 44 46, 48, 50 are generally parallel to one another and extend along the entire longitudinal extent of the deck support member. Score lines 40, 42 are folded in the same direction to define generally parallel walls 56, 58 of the first leg portion 34 once the support member is assembled. Likewise, score lines 48, 50 are folded in the same direction to define wall portions 60, 62 of the second leg portion 36. The score lines 44, 46 are folded in a direction opposite the previously mentioned score lines so as to dispose planar region 64 between wall portions 58, 60 in a generally horizontal plane. In other words, wall portions 58, 60 and the planar region 64 define an inverted, U-shaped support member in which region 64 matingly engages the deck 30 along a substantial portion thereof. Additional score lines 70, 72 extend along the merger region of flanges 74, 76 with the wall portions 56, 62, respectively. These score lines 70, 72 are folded in the same general direction as score lines 40, 42, 48, 50 to partially fold back over the cavities defined by the leg portions 34, 36 and retain the deck 30 therein.

Referring again to FIG. 2, disposed in each leg portion at opposite ends are block members 80, 82 and 84, 86. Each of the block members has a stepped, vertical face configuration that faces outwardly toward the ends of the deck support member. These block members, though, are axially recessed from the longitudinal ends of the support member. The stepped face configuration 90 includes a first pair of generally parallel faces 92, 94 and a second pair of parallel faces 96, 98 that are disposed perpendicular to the first pair. The face 94 of each block member is spaced from the edge of its respective leg portion and, likewise, face 96 spaced from either wall portion 56 or 62 to receive corner posts D therein.

The individual corner posts 110, 112, 114, 116 are multi-ply sheets bent along a fold line and are disposed in respective corners of the support member. More particularly, each corner post includes a first leg 118 that extends inwardly between either wall portion 56 or 62 and the generally planar face 96 of an associated block member. A second leg 120 of each corner post closes off the end face of each leg portion 34, 36 through mating, abutting engagement with face 94 of each block member. Each corner post is adapted to extend along the full height of the desk and have an upper end received in top member E.

The top member is also preferably folded from a generally planar corrugated blank member. With additional reference to FIG. 4, fold lines 130 dispose the peripheral flanges 132 downwardly and generally perpendicular to a planar top member 134. Additionally, a pair of fold lines 136, 138 are defined in the end flanges and cooperate with bisecting fold lines 140, 142 to define a folded back peripheral edge that interlocks with the side flanges of the top member. Once the top member is assembled as shown in FIG. 2, the upper ends of the corner posts are received within the top member peripheral edge.

First and second drawer protectors 148, 150 may also be provided over the handles of the drawers. Of course, with other pieces of furniture these additional protectors may not be necessary. Alternatively, different types of special packaging elements may be required for different articles of furniture.

With particular reference to FIG. 5, the extension members G will be described in greater detail. Certain types of furniture are available in incremental sizes, such as the desks under consideration. With desks, the longitudinal extent of the desk will increase in five, six, or twelve inch increments so that first and second extension members G are placed at one or both ends of the base member C to lengthen a "standard" packaging assembly. Each extension member lengthens the base member approximately five to six inches. As will become more apparent below, yet another set of extension members may be placed opposite the first set of extension members to increase the "standard" packaging assembly another five or six inch increment. Of course, one skilled in the art will realize that other incremental, dimensional relationships may be utilized within the spirit of the subject invention.

More particularly, each extension member includes first and second leg portions 152, 154 spaced by generally planar region 156. The leg portions and planar region have substantially the same configuration as the deck support member 32 of the base member for selective mating engagement therewith. Each extension member includes a deck 158 received over the planar region. Similarly, first and second block members 160, 162 are received in the leg portions of the extension member. The block members 160, 162 have a first or outer end that has the same configuration as the stepped face configuration of the previously described block members 80,82, 84, 86. In fact, to facilitate an understanding of the block member configuration, like numerals are used to identify like surfaces. A second or inner end of each block member of the extension member, though, has a generally L-shaped conformation that closely resembles the first and second legs of the corner posts. Specifically, a first leg 166 is received between either wall portion 56 or 62 and face 96 of the block member. A second leg 168 is adapted for mating engagement with face 94 of the block members.

Stated in another manner, the block members 160, 162 of the extension members have an interior face that closely resembles the conformation of the corner posts. This facilitates mating engagement between the extension member interior face and the block members of the base member. Additionally, an exterior face of the block members 160, 162 closely resemble the stepped face configuration of the base member block members. This arrangement facilitates mating engagement between the extension member exterior face and a corner post, or the interior face of another extension member.

Placing a single extension member on one end of the base member will, as indicated above, increase the overall length of the packaging assembly by approximately five to six inches. Additionally, disposing a pair of extension members at each end of the base member will extend the overall length of the base member by ten to twelve inches. Due to the interlocking, mating conformation of the block members of the base member with the block members of the extension members, incremental increases of the overall length of the packaging assembly are easily accommodated.

Figure 6:
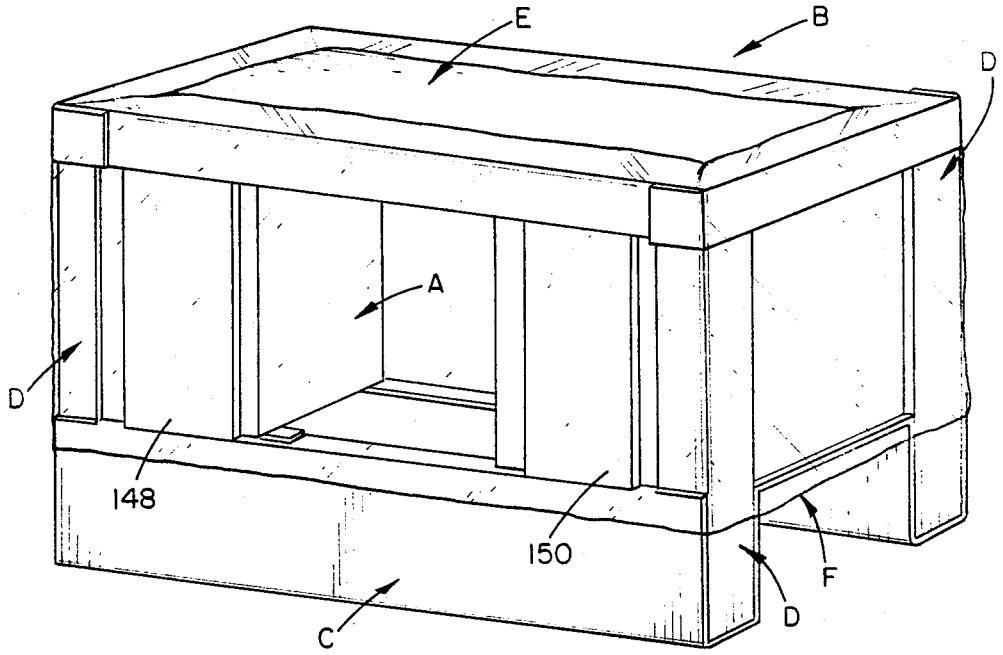

Lastly, and with reference to FIG. 6, once the base member, corner posts, and top member are situated around the article of furniture, the entire assembly is covered by a protective wrap F. In the preferred arrangement, the protective wrap is defined as a stretch-wrap plastic that easily conforms to the remainder of the packaging assembly. The wrap permits visual inspection of the goods and yet adequately keeps dirt and debris away from the packaged article.

The invention has been described with reference to the preferred embodiment. Obviously, modifications and alterations will occur to others upon a reading and understanding of the specification. It is intended to include all such modifications and alterations in so far as they come within the scope of the appended claims or the equivalents thereof.

Having thus described the invention, it is now claimed:

1. A packaging assembly adapted to protect an associated piece of furniture comprising:

a base member having (a) an elongated, generally planar deck, (b) a deck support member defined by a single sheet having predetermined fold lines forming first and second leg portions and a central platform disposed between said leg portions and supporting said deck;

four block members adapted to cushion legs of an associated piece of furniture received in said leg portions;

an extension member received on one end of said base member, said extension member having a predetermined conformation adapted for mating engagement with said block members;

first, second, third, and fourth corners of said base having a first end disposed at respective corners of said base member and operatively engaging one of said leg portions and extending generally perpendicularly outward from said deck; and, a cover member operatively engaging second ends of said corner posts and being spaced from said deck to define a cavity therebetween adapted to receive an associated piece of furniture therein.

2. The packaging assembly as defined in claim 1 wherein said block members are spaced inwardly from longitudinal edges of said leg portion.

3. The packaging assembly as defined in claim 1 wherein a first and second of said block members are received at one end of said base member and have a stepped conformation that mates with a mirror image, stepped conformation on said extension member.

4. The packaging assembly as defined in claim 1 further comprising a protective wrap received around a portion of said base member, around said corner posts, and partially around said cover member.

5. The packaging assembly as defined in claim 1 wherein said corner posts are defined by multi-ply sheets folded along a fold line to define first and second angled portions adapted to wrap around a leg of an associated piece of furniture.

6. A packaging assembly adapted to protect an article during shipment comprising:

a base member having first and second leg portions and a central platform disposed between said leg portions;

a block member received in said leg portions, a first face of said block member having a first predetermined configuration;

plural posts each having a first end adapted for receipt in one of said first and second leg portions of said base member and a second end extending outwardly from said first end, said posts having a second predetermined configuration adapted for mating engagement with said first predetermined configuration of said block member;

an extension member received on one end of said base member, a first face of said extension member having a third predetermined configuration substantially the same as said second predetermined configuration for mating engagement with said block member first predetermined configuration;

a cover member operatively engaging said second ends of said posts and being spaced from said central platform to define a cavity therebetween adapted to receive an associated article.

7. The packaging assembly as defined in claim 6 wherein a second face of said extension member has a fourth predetermined configuration substantially the same as said first predetermined configuration for mating engagement with the second predetermined configuration of a post.

8. The packaging assembly as defined in claim 6 wherein said base member includes an elongated, generally planar deck received on said central platform.

9. The packaging assembly as defined in claim 6 further comprising a protective wrap received around a portion of said base member, around said posts, and partially around said cover member.

10. The packaging assembly as defined in claim 6 wherein said posts are defined by multi-ply sheets bent along a fold line.

11. A packaging assembly comprising:

a base member having (a) an elongated, generally planar deck;

(b) a deck support member defined by a single sheet having predetermined fold lines forming first and second leg portions and a central platform disposed between said leg portions and supporting said deck;

an extension member received on one end of said base member;

first, second, third, and fourth corner posts each having a first end operatively engaging one of said leg portions and extending generally outward from said deck; and, a cover member operatively engaging second ends of said corner posts and being spaced from said deck to define a cavity therebetween adapted to receive and associated article.

12. The packaging assembly as defined in claim 11 further comprising a second extension member received at another end of said base member.

13. A packaging assembly comprising:

a base member having first and second leg portions disposed on opposite sides of a platform;

a base member extension having first and second leg portions disposed on opposite sides of a platform, means for interlocking the leg portions of said base member with the leg portions of the base member extension, a cover member including means cooperating with said base member to define an article receiving cavity;

14. The packaging assembly as defined in claim 13 including first and second base member extensions received on opposite ends of said base member.

15. The packaging assembly as defined in claim 13 wherein said means cooperating with said base member includes at least one post extending between said base member and cover member.

16. The packaging assembly as defined in claim 13 wherein said means for interlocking the leg portions includes block members each having a generally stepped configuration for mating engagement with each other.

* * * * *